US007309249B2

(12) United States Patent
Pabst et al.

(10) Patent No.: US 7,309,249 B2
(45) Date of Patent: Dec. 18, 2007

(54) CONNECTOR FOR JOINING TWO CONDUCTORS

(75) Inventors: Thomas Bernhard Pabst, Röthenbach a.d. Pegnitz (DE); Hans-Otto Geltsch, Berg-Sindlbach (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/533,468

(22) PCT Filed: Oct. 22, 2003

(86) PCT No.: PCT/EP03/11724

§ 371 (c)(1),
(2), (4) Date: Mar. 27, 2006

(87) PCT Pub. No.: WO2004/040705

PCT Pub. Date: May 13, 2004

(65) Prior Publication Data

US 2006/0199421 A1 Sep. 7, 2006

(30) Foreign Application Priority Data

Oct. 31, 2002 (DE) ..... 102 50 927

(51) Int. Cl.
*H01R 13/62* (2006.01)
*H01R 12/24* (2006.01)

(52) U.S. Cl. ..... 439/329; 439/499

(58) Field of Classification Search ..... 439/329, 439/507, 67, 418, 422, 391, 492, 499
See application file for complete search history.

(56) References Cited

U.S. PATENT DOCUMENTS

| | | | | |
|---|---|---|---|---|
| 3,336,564 | A * | 8/1967 | McCaughey | 439/391 |
| 4,420,211 | A * | 12/1983 | Ledbetter | 439/408 |
| 4,900,264 | A * | 2/1990 | Bennett et al. | 439/391 |
| 5,820,404 | A * | 10/1998 | Chishima et al. | 439/417 |
| 6,080,006 | A | 6/2000 | Broder | 439/409 |
| 6,299,264 | B1 * | 10/2001 | Kautsch et al. | 305/137 |
| 6,299,469 | B1 | 10/2001 | Glovatsky et al. | 439/329 |

FOREIGN PATENT DOCUMENTS

| | | |
|---|---|---|
| DE | 198 32 011 A1 | 2/2000 |
| DE | 198 38 423 A1 | 3/2000 |
| DE | 199 46 468 A1 | 5/2001 |
| DE | 100 65 972 A1 | 7/2002 |
| EP | 0 834 957 A1 | 4/1998 |
| EP | 1 039 791 A1 | 9/2000 |
| JP | 7-130415 | 5/1995 |
| WO | WO 02/13316 A1 | 2/2002 |

* cited by examiner

*Primary Examiner*—Chandrika Prasad
(74) *Attorney, Agent, or Firm*—Harrington & Smith, PC

(57) ABSTRACT

The invention relates to a connector for joining two conductors, including a first semi-housing and a second semi-housing that can be moved from a position in which said second semi-housing is in a pre-locked state with the first semi-housing into a final locked position. The inventive connector also comprises an electrically conducting clamp which contacts and interconnects the two conductors in the final locked position.

10 Claims, 10 Drawing Sheets

CONNECTOR FOR JOINING TWO CONDUCTORS

FIELD OF THE INVENTION

The present invention concerns a plug connector for connecting two conductors. The invention particularly concerns a plug connector for connecing two flat flex conductors. Overall it finds application where two conductors must be connected with one another by their conductive tracks, for example, in the automobile industry or in computer technology.

BACKGROUND OF THE INVENTION

Flat flex conductors are finding a continually broader field of application in many fields of technology, since higher current intensities can be achieved due to the width of the conductive tracks and the larger conductor cross section associated therewith, and since the conductors, with a small height in space and arranged in tracks next to one another, can be incorporated into other components.

Due to the frequent use of ribbon conductors, the requirement has now arisen for connecting different ribbon conductors in a simple way, for example, for producing a cable harness, in order to be able also to bridge over longer distances.

From DE 198 32 011 A1 is disclosed a connection region for the detachable connection of two ribbon conductors, one of the conductors being wound around springs with contact curvatures provided in the housing, and the contact curvatures being pressed onto the conductive tracks of the other conductor. The introduction of the first conductor in the connection region, however, is complicated and time-consuming.

SUMMARY OF THE INVENTION

The object of the present invention is thus to provide a plug connector that is simple to construct and simple to actuate, with which conductors, in particular, flat flex conductors can be joined together in a simple way.

This object will be solved by a plug connector according to patent claim 1.

According to the invention, for connecting two conductors, the plug connector has a first housing half, a second housing half, which can be locked with the first housing half from a prelocking position into a final locking position, and an electrically conductive clamp, which contacts the two conductors in the final locking position and connects them electrically with one another. In the present invention, the term "housing half" does not limit the geometric shape to half. Rather, each half can have any shape.

Preferably, the conductors used are flat flex conductors. These usually have several conductive tracks running parallel to one another on a non-conducting flexible substrate.

In a preferred embodiment, the clamp is U-shaped, wherein each of the two legs of the U-shaped clamp contact at least one conductor in their final locking position. The connection plate of the two legs of the clamp is preferably rigidly disposed in one of the two housing halves.

The clamp is preferably disposed in a recess in one of the two housing halves, whereby the other housing half has a shoulder, which presses the conductors into the recess between the two legs of the clamp in final locking position. According to the invention, by actuating the second housing half, the latter is pressed in the direction of the first housing half from the prelocking position into the final locking position, by which means the conductor is shifted onto the clamp by the shoulder formed on the other housing half. The conductors are pressed onto the legs. Preferably, each leg has a depression or a notch, into which the conductor or the conductors can be pressed. In this case, the ends of the conductors to be connected can be stripped of insulation, but they also can be surrounded by an insulator and pressed onto each leg on the depression or the notch. At their contact point in the insert, the legs can be created in such a way that they cut through an insulating sheath of the conductor, so that a prior removal of the insulating sheath is not necessary.

Further, one housing half can have a rib, which presses one of the two conductors in a depression formed on the other housing half in the final locking position, by means of which a strain relief is formed for the conductor. Due to the locking of the housing halves in the final locking position, in addition to the electrical connection of the two conductors, a strain relief can be formed in a simple way for the conductors.

Preferably, each housing half has a rib and a depression, whereby the rib of each housing presses a conductor into the depression of the other housing, by means of which a strain relief is formed for both conductors which are to be connected.

The rib formed on the housing halves can form a stop for both conductors simultaneously, which are inserted into the plug connector on the opposite-lying sides of the plug connector.

In a preferred embodiment, the two conductors can be inserted into the plug connector far enough that they overlap over the clamp and that each leg of the clamp contacts both conductors in final locking position. Likewise, however, the conductors can be introduced only so far into the plug connector that the conductors do not overlap over the clamp and each leg of the clamp contacts only one conductor.

In another embodiment, one of the housing halves can also be formed of two parts, wherein each part of this housing half can be locked individually with the other housing half in final locking position. When it is locked in final locking position, preferably each part of the housing half formed in two parts can press one conductor onto one leg of the clamp. Thus, any conductor can be connected with the clamp independently from the other conductor, by pressing the part of the housing half lying above the leg of the clamp in final locking position.

Preferably, each leg of the clamp has a notch, in which at least one conductor is clamped in final locking position. Either one or two conductors are clamped in each leg of the clamp, depending on whether the two conductors overlap over the clamp.

The leg, however, can also have two opposite-lying clamp arms, which are separated from one another by a notch. In another preferred embodiment, the clamp is a cutting clamp, so that the contact conductor pressed into the leg of the clamp is solidly clamped and any insulation that may be present is stripped off, so that the clamp directly contacts the conductor.

In addition, the plug connector can have cutting devices which separate the conductive tracks from one another in a conductor with several such tracks, when the second housing half is locked in final locking position. In this way, it is assured that the conductor insulation lying between the conductive tracks is totally disrupted if the conductive tracks are pressed onto the leg of the clamp.

BRIEF DESCRIPTION OF THE DRAWINGS

The invention will be described below in more detail below with reference to the appended drawings. Here.

DETAILED DESCRIPTION OF THE INVENTION

Figure 1:
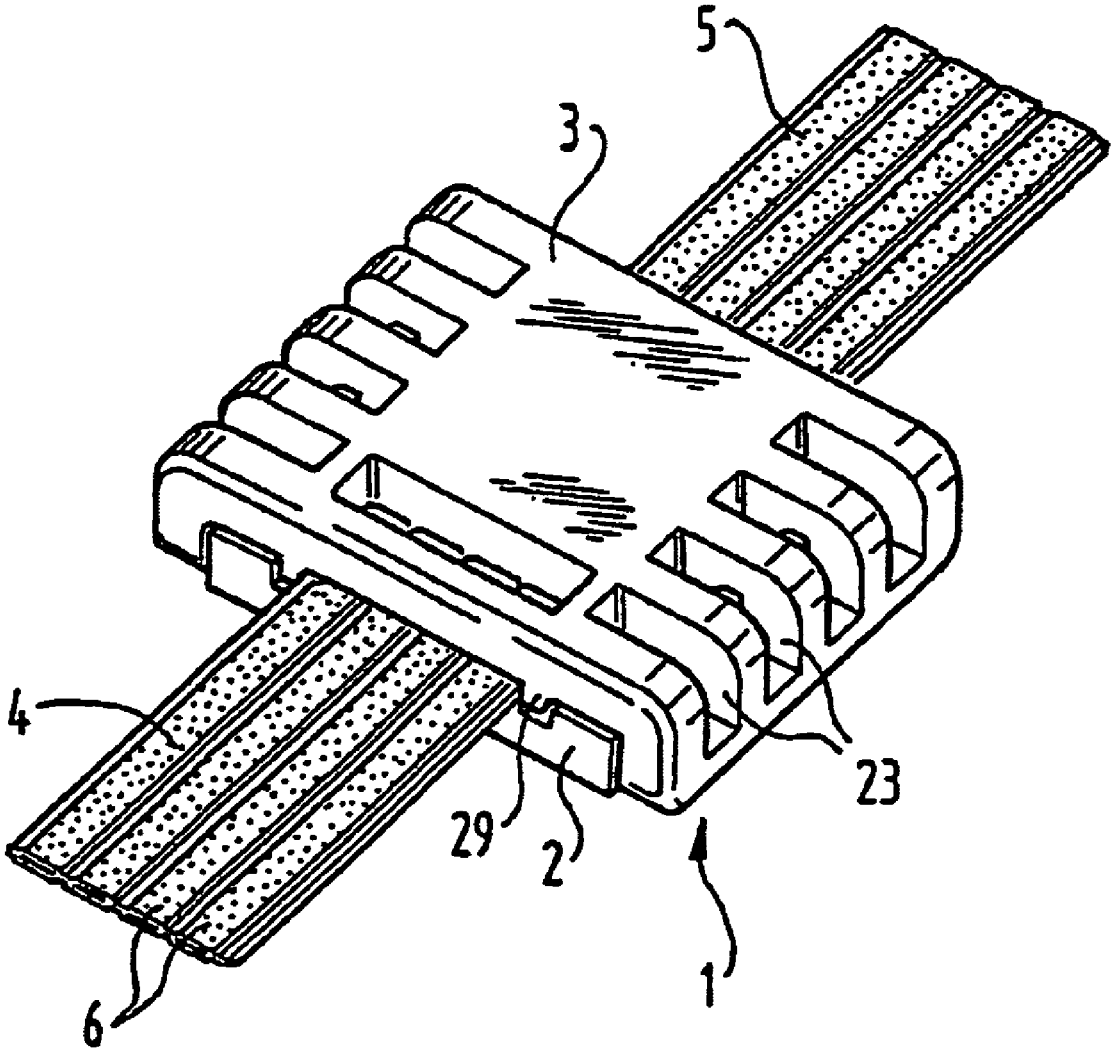
FIG. 1 shows a perspective view of a plug connector according to the invention.

FIG. 1 shows a plug connector 1, which has a first housing half 2 and a second housing half 3. The plug connector connects a conductor 4 with a conductor 5. In the embodiment shown, the conductors 4,5 are flat flex conductors with several conductive tracks 6.

Figure 2:
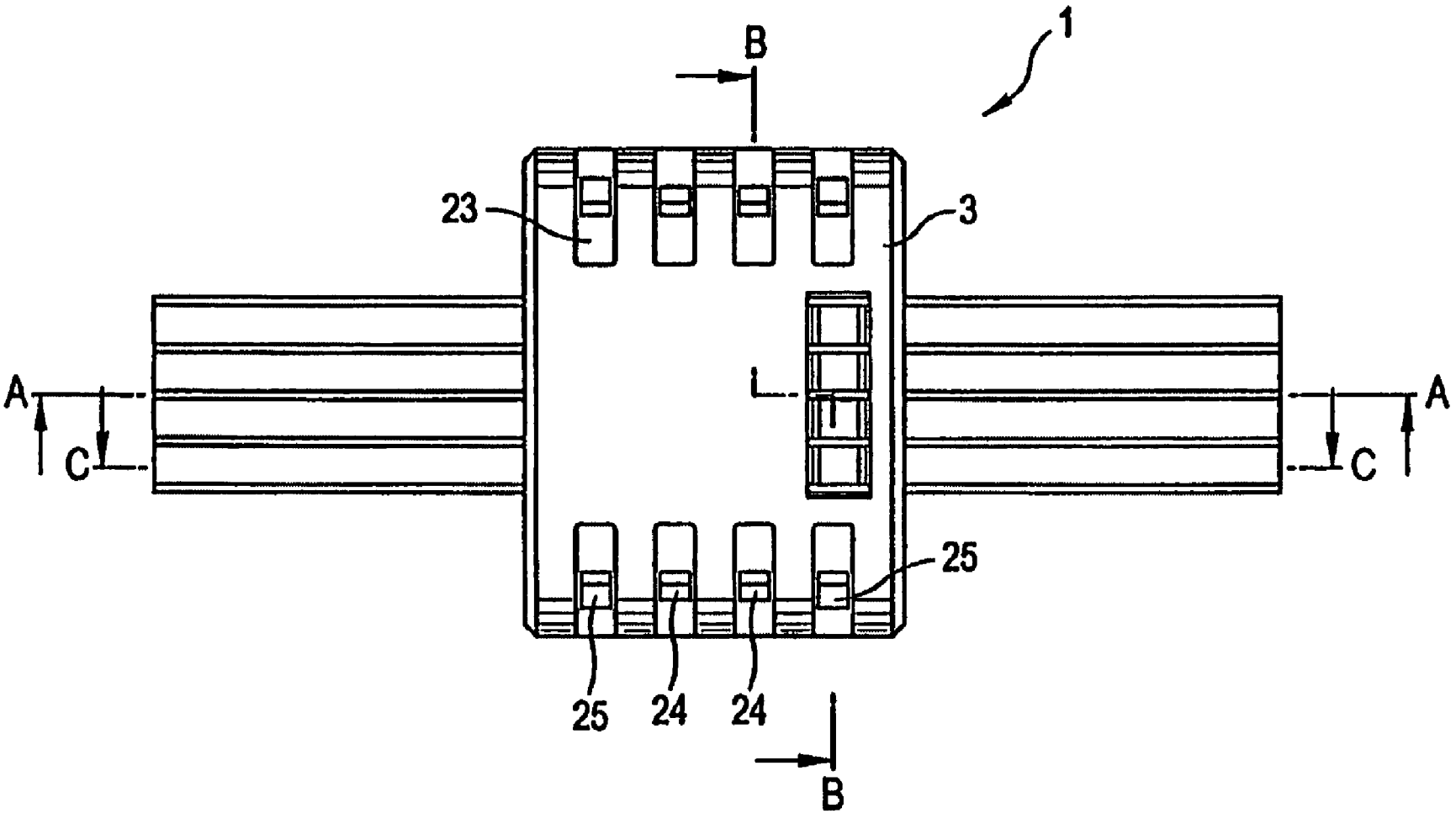
FIG. 2 shows a view onto the plug connector of FIG. 1.

FIG. 2 shows the plug connector of FIG. 1 in a top view.

Figure 3:
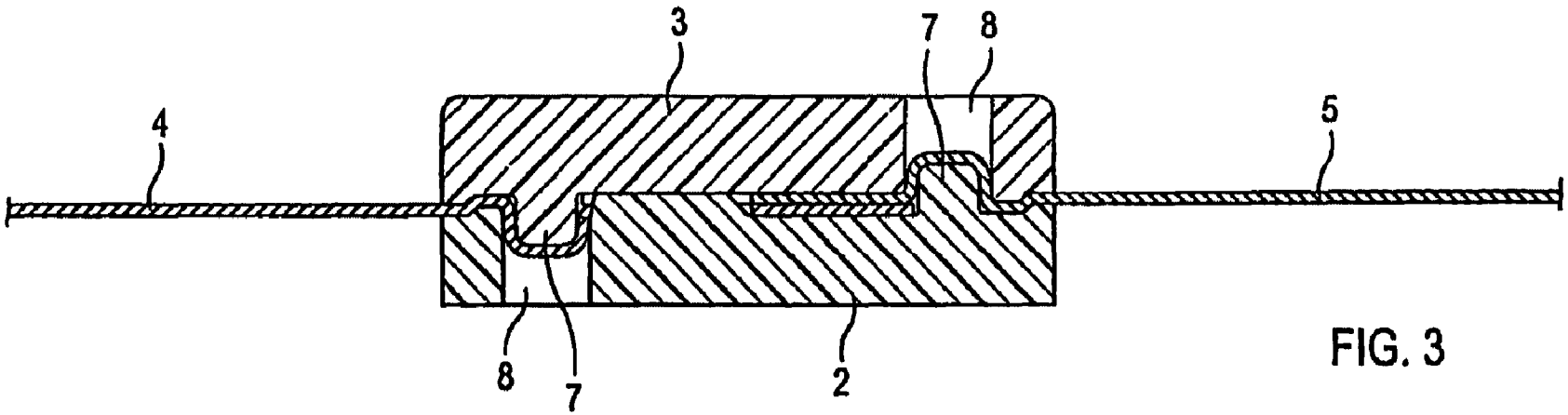
FIG. 3 shows a section along A-A of FIG. 2.

FIG. 3 shows a section along A-A of FIG. 2. In this section, which is executed between two conductive tracks, it can be seen how the two conductors 4,5 are connected with the two housing halves 2,3. Each housing half has a rib 7, which projects into a recess 8 of the other housing half. The two conductors 4,5 are each pressed into the recess 8 by the rib 7 and thus are attached between the two housing halves 2,3. A strain relief for both conductors 4,5 is simultaneously formed by this arrangement.

Figure 4:
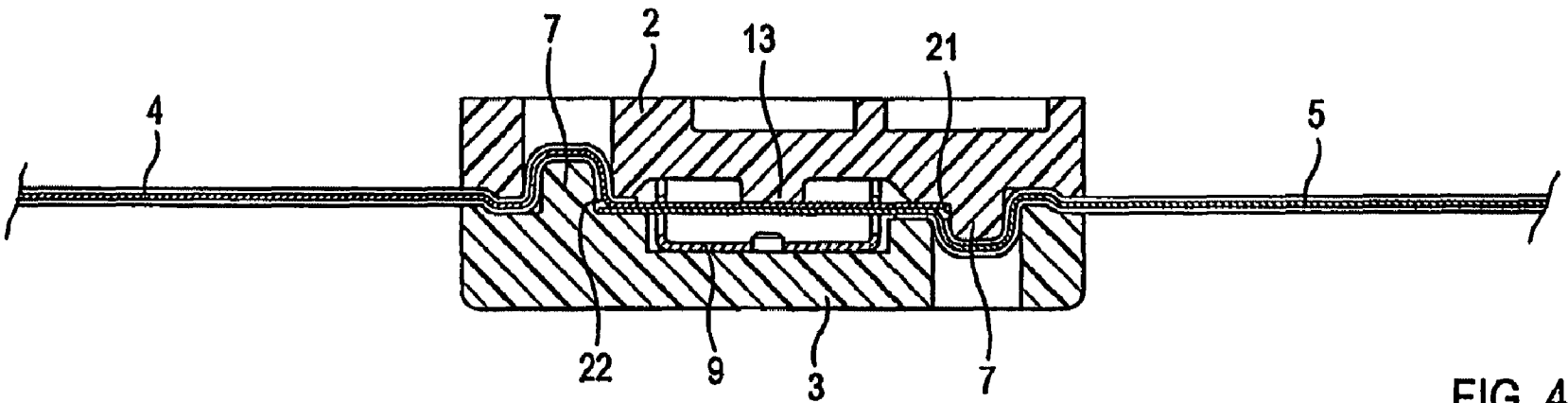
FIG. 4 shows a section along C-C of FIG. 2.

FIG. 4 shows a section along a conductive track through the plug connector 1 along the section line C-C, wherein the two housing halves 2, 3 lie in final locking position. One of the conductors 4, coming from the left in FIG. 4, runs over the rib 7, and further over an electrically conducting clamp 9, which is described in more detail in FIGS. 9 and 10.

Figure 9:
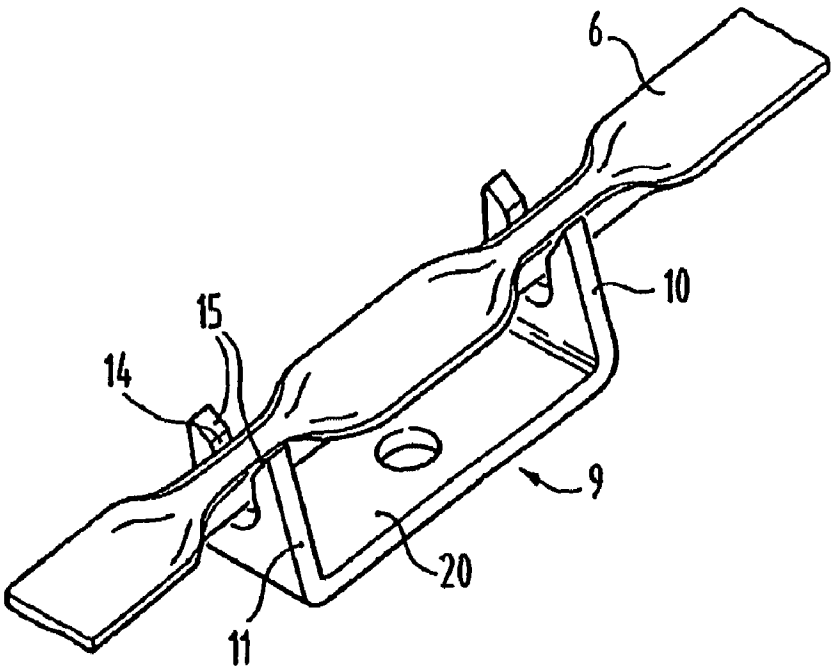
FIG. 9 shows a first embodiment of the electrically conducting clamp.

As shown in FIG. 9, the clamp 9 is U-shaped and has two legs 10, 11. In the embodiment shown in FIG. 4, the clamp 9 is disposed in a recess 12 in the second housing half 3. The first housing half 2 has a shoulder 13, which presses the conductor between the two legs 10, 11 in the direction of the second housing half 3. As can be seen in FIG. 9, each of the two legs 10, 11 has a notch 14, into which the conductor is pressed by its conductive track 6. The leg 10,11 with its notch 14 can be designed in such a way that the sides 15 of the leg facing one another form a cutting surface, so that any insulation that may be present on the conductive track 6 is stripped. The notch 14 is V-shaped and tapers downward, so that the conductive track 6 is clamped in notch 14.

Figure 10:
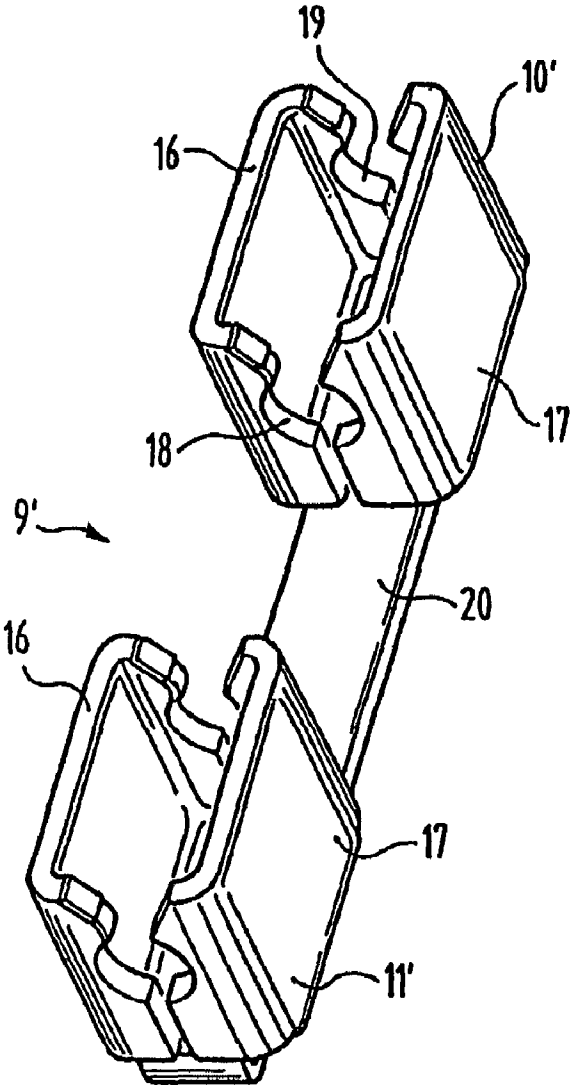
FIG. 10 shows a second embodiment of the electrically conducting clamp.

FIG. 10 shows a second embodiment according to the invention of a conducting clamp 9', which can be used. The two legs 10', 11' are formed here as two opposite-lying clamp arms 16, 17, which are themselves also U-shaped. On the opposite-lying ends of the clamp arms 16, 17, the latter are formed in relief, so that an essentially V-shaped notch is formed between the two clamp arms 16, 17. At the ends 18 of the clamp arms, the latter have a rounded part, in which the conductor or the conductors is (are) held in place.

The legs 10, 11 or 10', 11' of FIGS. 9 and 10 are connected together each time via a crossbrace 20, with which, for example, the clamp can be held in place in one housing half.

In the embodiment shown in FIG. 4, the conductor 4 runs in from the left, passing over rib 7 of the housing half 3 and over the clamp 9 up to the rib of the housing half 2, which forms simultaneously a stop 21 for the conductor 4. Likewise, the conductor 5 runs in from the right in FIG. 4, passing over rib 7 of the housing half 2, over the clamp 9 up to the rib 7 of the second housing half 3, serving as stop 22. In the embodiment shown, the conductors lie on top of one another over clamp 9.

Figure 5:
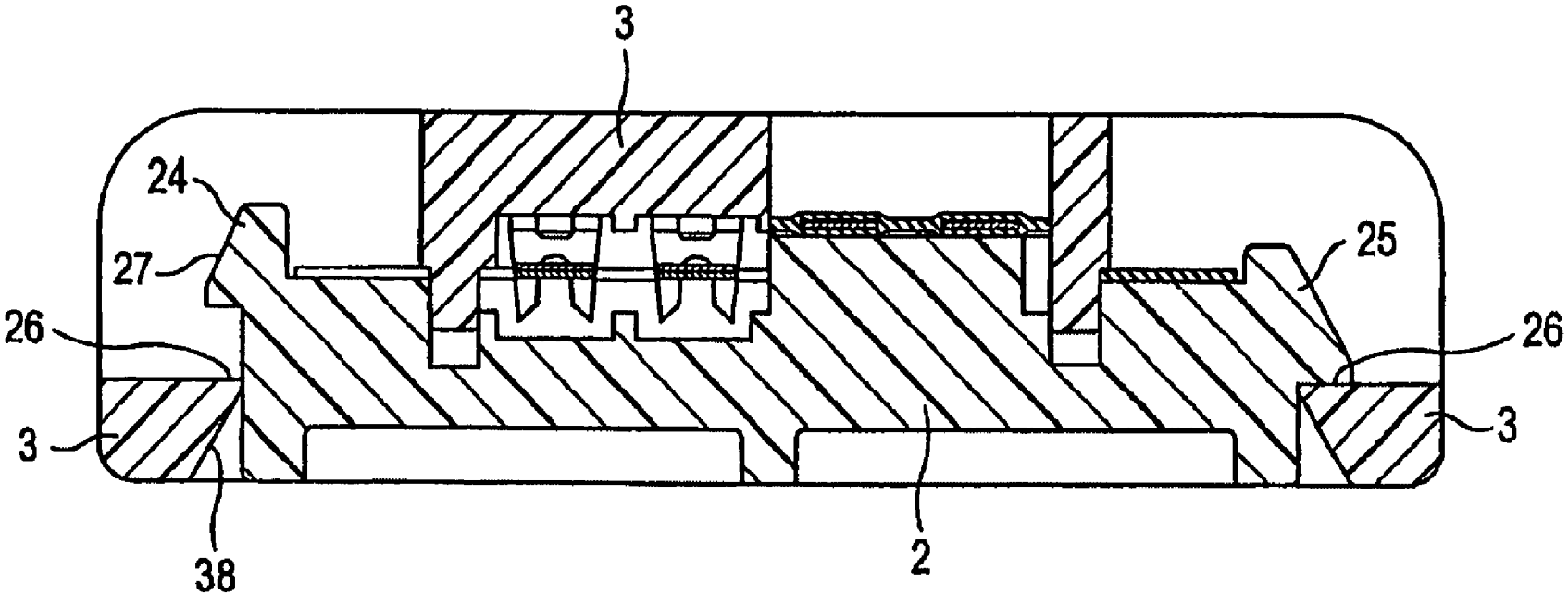
FIG. 5 shows a section along B-B of FIG. 2.

A section B-B through the plug connector shown in FIG. 2 is shown in FIG. 5. As shown in FIGS. 1 and 2, the second housing half has grooves 23, which cooperate with first blocking shoulders 24 or second blocking shoulders 25 formed on the first housing half, in order to lock the two housing halves 2,3 with one another. The blocking shoulder 24 holds the first housing half 2 in the grooves 23 in the prelocking position, while the blocking shoulders 25 hold the second housing half 3 in place in the final locking position at catch shoulders 26, which are disposed on the second housing half 3.

As can be recognized, among other things, in FIG. 5, the prelocking and final locking positions are achieved by means of the different lengths and positions of the first blocking shoulder 24 and the second blocking shoulder 25. In the prelocking position, the first blocking shoulder 24 lies with its beveled end 27 at the incline 38. Due to the slight spring-loaded formation of the first blocking shoulder 24, the first housing half 2 can be pressed from the prelocking position into the final locking position.

Figure 6:
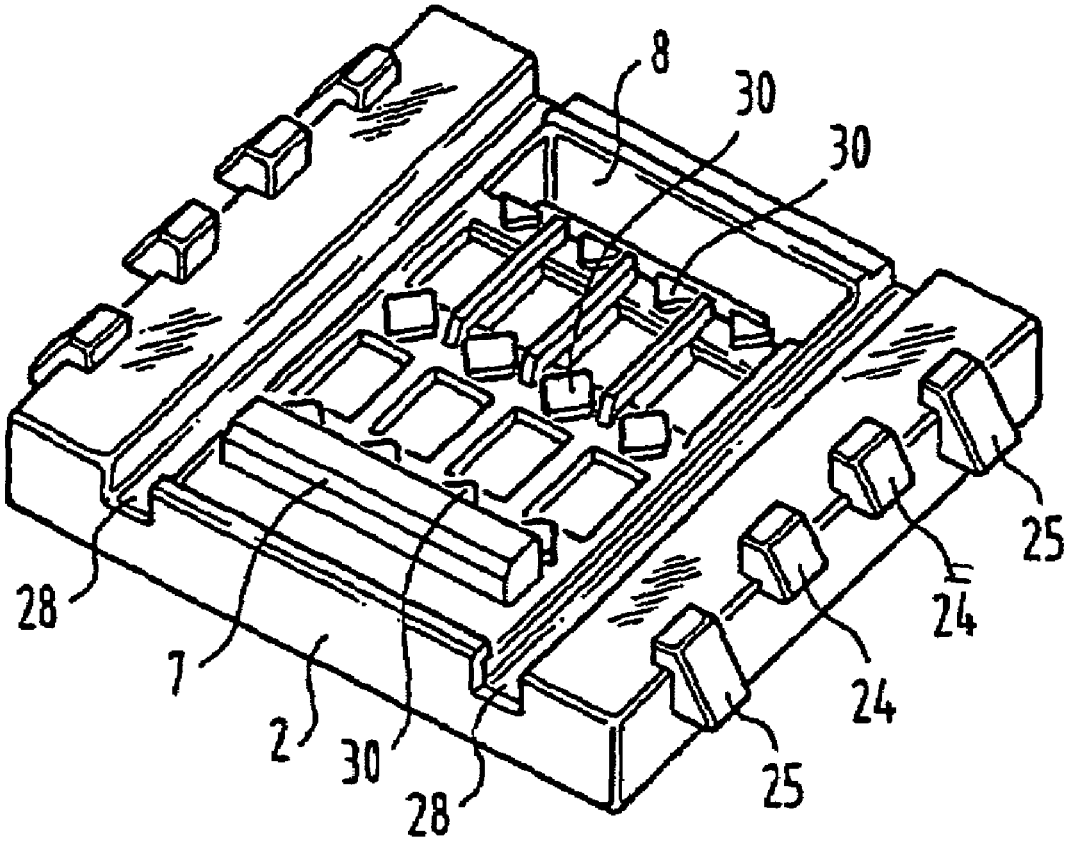
FIG. 6 shows a perspective view of the second housing half from below.

The first housing half 2 with its bottom side, which is pressed onto the second housing half 3, is shown in FIG. 6. On this bottom side can be recognized the rib 7 as well as the recess 8, which are disposed for the strain relief of the two conductors. For guiding the two conductors in the plug connector, the first housing half 2 has channels 28 in the direction of the conductors, in which the projections 29 of the second housing 3 engage, so as to produce a lateral guide for the conductors 4, 5. At the level of the conductive tracks, the first housing half also has raised pieces 30, which deform the conductive tracks in such a way that the conductive track 6, as illustrated in FIG. 9, is pressed into the legs 10, 11 of clamp 9.

Figure 7:
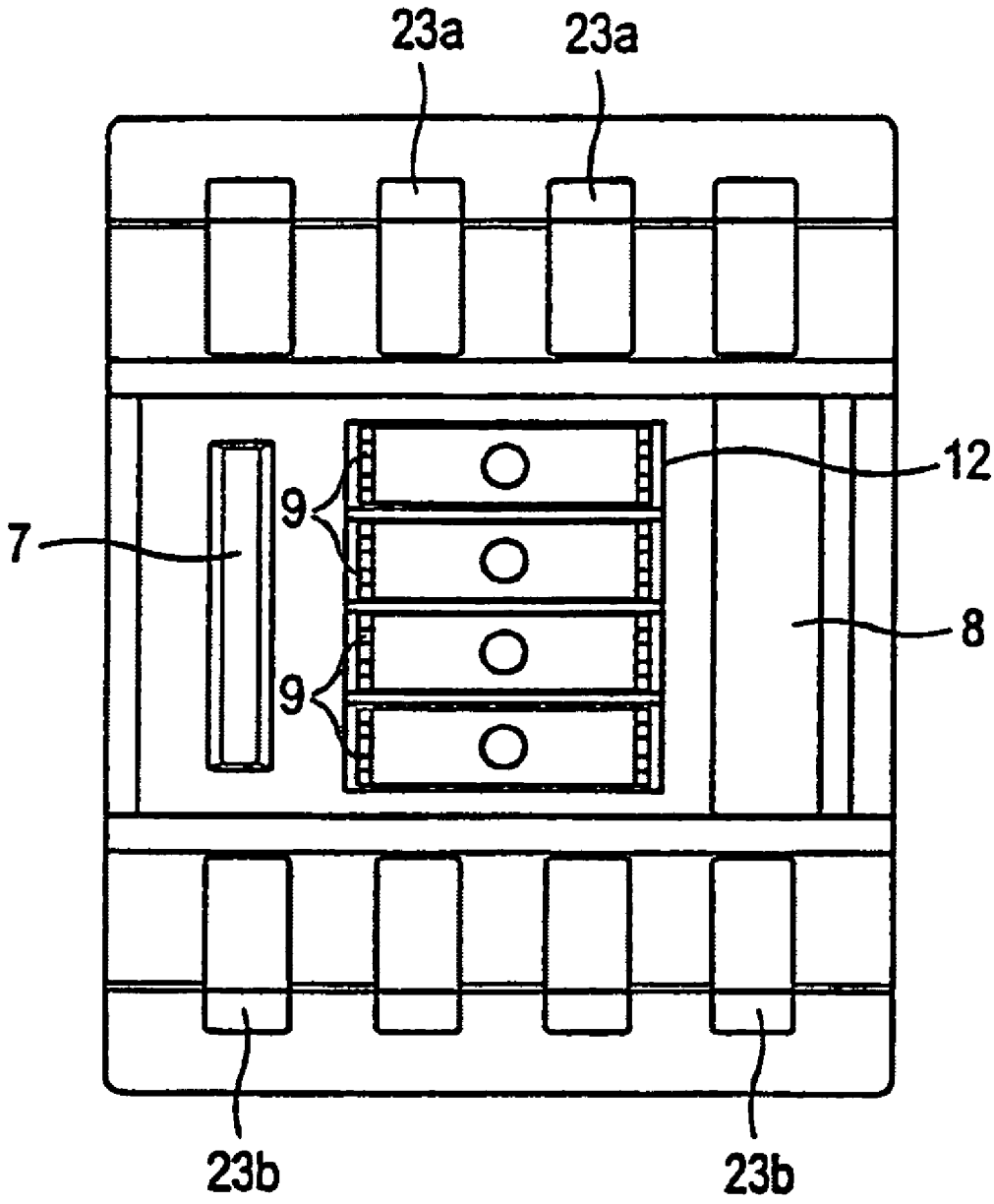
FIG. 7 shows a view onto the lower housing half with clamp.

The second housing half 3 is shown in FIG. 7 in a top view, wherein four clamps 9 lie in the recess 12 in the embodiment shown. In addition, grooves 23*a* are shown, in which engage the first blocking shoulders 24 of the first housing half 2, and which define the prelocking position. Likewise, the grooves 23*b* are shown, in which engage the second blocking shoulders 25. In addition, the rib 7 and the recess 8 for the strain relief are shown.

Figure 8:
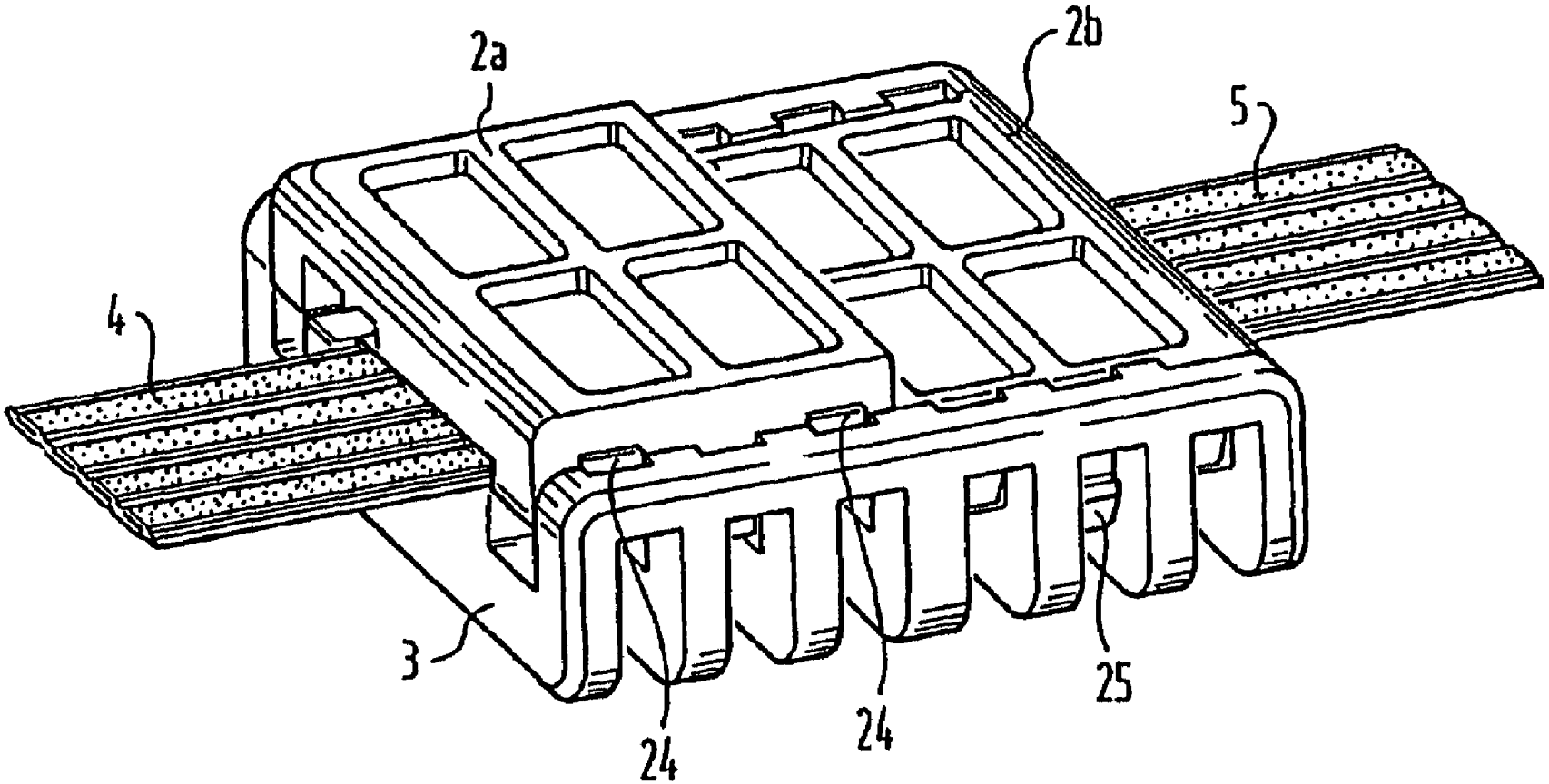
FIG. 8 shows a second embodiment of the plug connector according to the invention with a two-part second housing half.

In FIG. 8, a second embodiment according to the invention is shown, wherein the first housing half 2 is formed of two parts. The first part 2*a* of the housing half can be brought into the final locking position independently from the second part 2*b* of the housing half. The first part of the housing half each time lies over one of the two legs 10, 11 of clamp 9, while the other part of the housing half 2 lies over the other leg of clamp 9. In the embodiment shown, each part 2*a*, 2*b* of the housing half has first and second blocking shoulders 24 and 25 for the prelocking and final locking positions.

In the preferred embodiment shown in FIG. 8, the two conductors 4, 5 do not lie over the (not shown) clamp 9 in an overlapping manner, so that when each part 2*a*, 2*b* of the housing half is locked, only one conductor is pressed each time into clamp 9. In a preferred embodiment, in the case of the two-part first housing half, the clamp shown in FIG. 10 is used, which has two clamp arms 16, 17 for each conductor 4, 5. The clamp shown in FIG. 9, however, can also be used equally well for the embodiment of FIG. 8.

The two-part first housing half 2*a*, 2*b* is shown from below in FIG. 11, wherein clamps 9' are put in place for two conductive tracks 6 of conductor 5. Likewise, the raised pieces 30 are shown, which press the conductive tracks 6 into the rounded parts 19 of clamp 9'. In addition, the first and second blocking shoulders 24 and 25 for locking in the prelocking or final locking position are shown disposed laterally on opposite-lying ends of the first housing. As can be recognized, the insulation is stripped from the ends of conductor 5, so that the conductive track 6 stripped of insulation is pressed between the two clamp arms 16, 17 of FIG. 10. By locking each housing part 2*a*, 2*b* in final locking position, the conductive tracks 6 of each conductor 4,5 are connected each time with a leg 10, 11* of clamp 9'.

Figure 11:
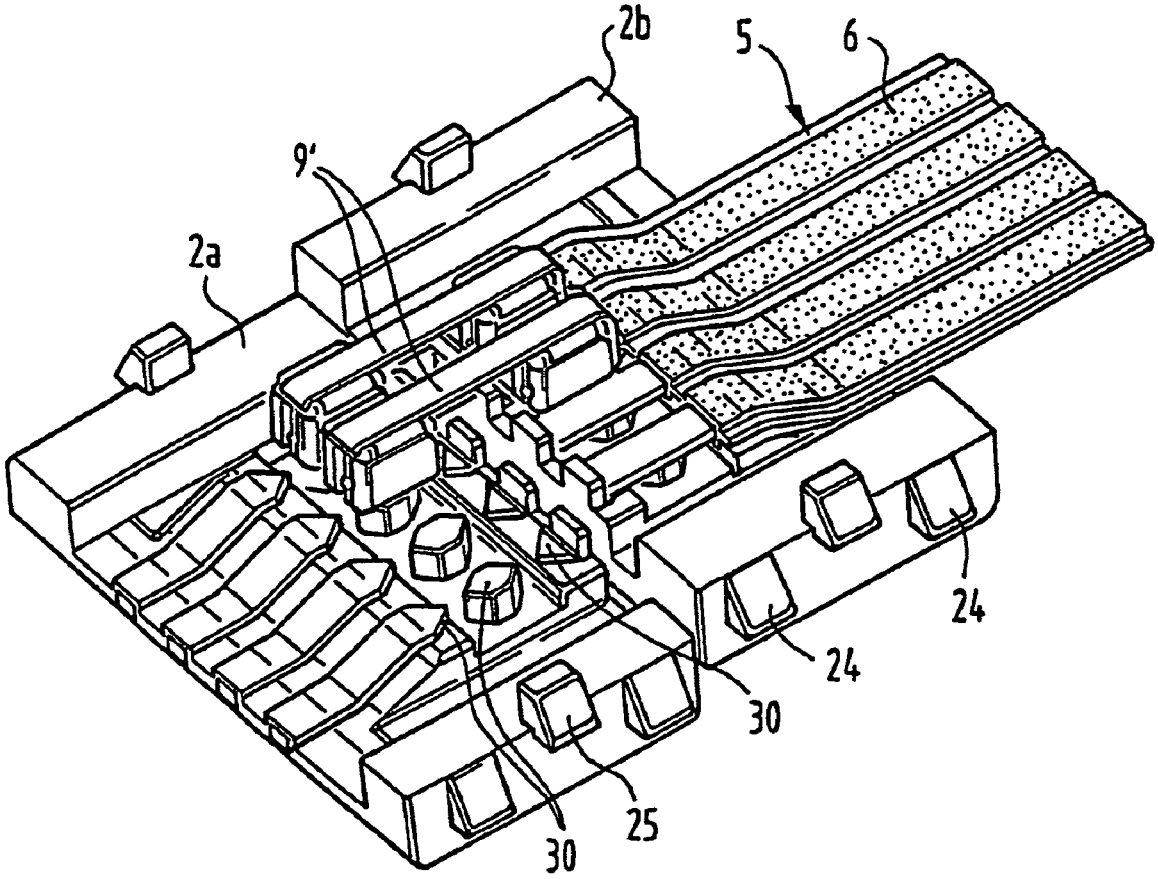
FIG. 11 shows a perspective view of the two-part second housing half from below with the clamp of FIG. 9.

The clamp 9 shown in FIG. 9, however, can also be used equally well in the case of the two-part embodiment of the first housing half 2, which is shown in FIG. 11, and the conductors can overlap. The conductive tracks of the conductors in FIGS. 8 and 11 to 12 can also be used equally well without being stripped of insulation. The clamps are then created such that they cut through the insulator of the flat flex conductor.

Both embodiments of the clamps can thus be used—with conductive tracks either stripped of insulation or not so stripped.

Figure 12:
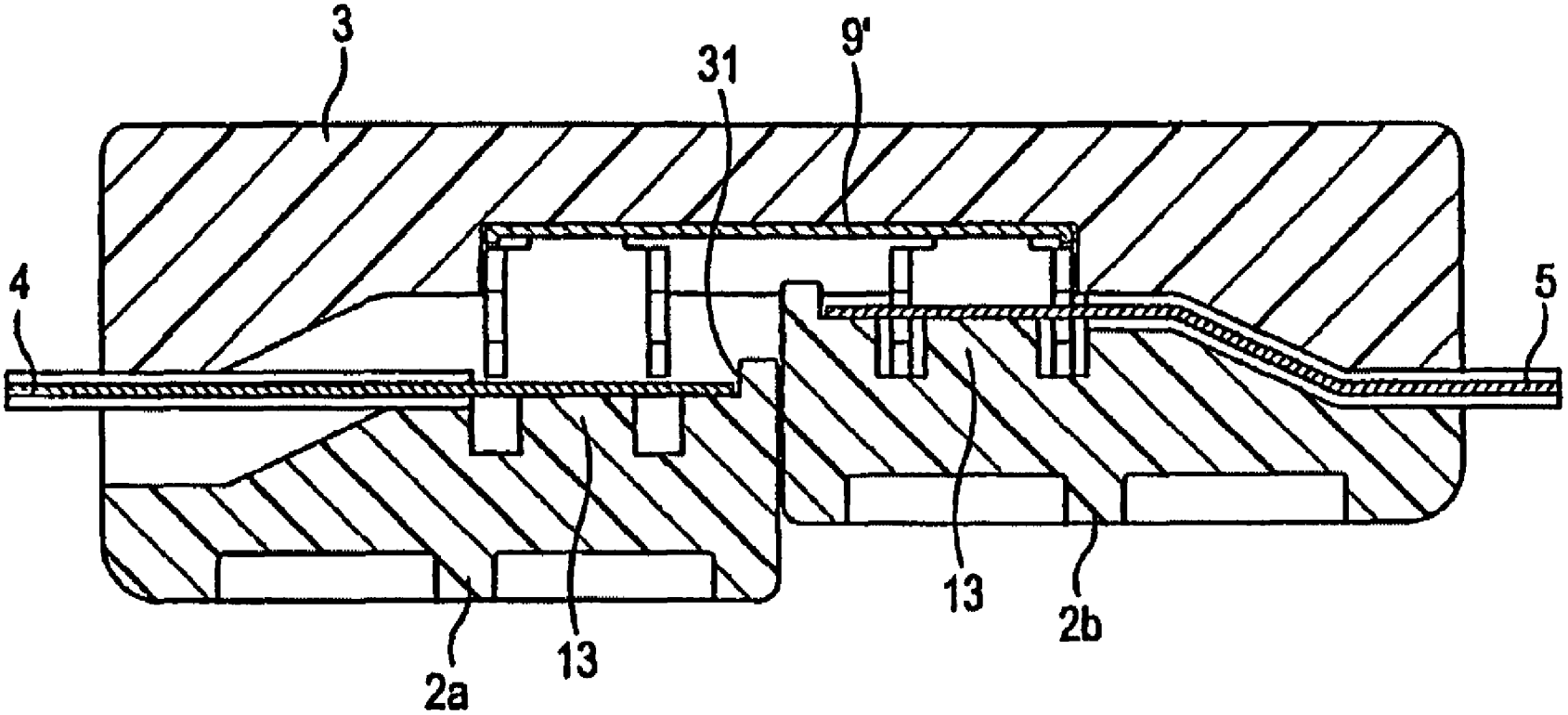
FIG. 12 shows a section through the two-part housing half along a conductive track.

A section through the embodiment of the plug connector of FIG. 8 is shown in FIG. 12. As shown in FIG. 12, the housing part 2*b* is locked in final locking position, while the housing part 2*a* lies in prelocking position. Each housing part 2*a*, 2*b* has a stop 31, up to which the conductor 4 or 5, respectively, can be inserted into plug connector 1. In addition, it can be seen how the shoulder 13 presses the conductor in the direction of clamp 9', whereby the conductors 4, 5 each contact a leg 10, 11 of clamp 9 or 9', respectively.

In summary, it is established that two conductors can be connected in a simple way with the plug connector according to the invention. The geometry of the housing halves as well as the clamps can also be designed in other ways, just as long as the clamp connects the two conductors 4, 5 with one another in final locking position, so that the electrical contacting between conductors 4, 5 is assured.

The invention claimed is:

1. A plug connector for connecting at least two conductors, wherein the plug connector comprises:

a first housing half;

a second housing half which is adapted to be locked with the first housing half at a prelocking position, and wherein the second housing half is adapted to be moved on the first housing half to a final locking position; and an electrically conductive clamp connected to the first or second housing half, wherein the two conductors are flat conductors of a flexible ribbon conductor and the clamp is adapted to pierce through insulation of the flexible ribbon conductor to clamp onto the flat conductors, and wherein the clamp is adapted to place the two conductors in contact with each other in the final locking position and connect the conductors electrically with one another.

2. The plug connector according to claim 1, further characterized in that the clamp is U-shaped comprising two legs, wherein each of the two legs of the U-shaped clamp contact at least one of the conductors in the final locking position.

3. The plug connector according to claim 2, further characterized in that the clamp is arranged in a recess in one of the two housing halves, whereby the other housing half has a shoulder, which presses the conductors into the recess between the two legs of the clamp in final locking position.

4. The plug connector according to claim 1, further characterized in that the first housing half has a rib, which presses a first one of the conductors into a recess formed on the second housing half in the final locking position, by means of which a strain relief is formed for the first conductor, whereby the rib forms a stop for an end of a second one of the conductors.

5. The plug connector according to claim 2, further characterized in that the two conductors overlap over the clamp and each leg of the clamp contacts both conductors in the final locking position.

6. The plug connector according to claims 1, further characterized in that one of the housing halves is formed in two parts, and each part of this housing half can be locked individually with the other housing half in the final locking position, wherein, when locking in the final locking position, each part of the one housing half presses one of the conductors onto one leg of the clamp.

7. The plug connector according to claim 2, further characterized in that each leg of the clamp has two opposite-lying clamp arms, which are separated from one another by a notch.

8. The plug connector according to claim 1, further characterized in that the clamp is a cutting clamp.

9. The plug connector according to claim 1, further characterized in that each conductor has several conductive tracks, and that the plug connector has cutting devices, which separate the conductive tracks from one another, when the two housing halves are locked in final locking position.

10. An electrical connector for connecting at least two conductors, wherein the connector comprises:

a housing comprising a first housing member and a second housing member, wherein the second housing member is adapted to be locked with the first housing member at a prelocking position, and wherein the second housing member is adapted to be moved on the first housing member to a final locking position; and an electrically conductive clamp connected to the housing, wherein the two conductors are flat conductors of a flexible ribbon conductor and the clamp is adapted to clamp onto the flat conductors, and wherein the housing is adapted to move the flat conductors into the clamp when the first and second housing members are moved to the final locking position to thereby connect the flat conductors electrically with one another.

* * * * *